United States Patent [19]

Bohanon, Sr.

[11] Patent Number: 4,512,242

[45] Date of Patent: Apr. 23, 1985

[54] HEAT DESTRATIFICATION METHOD AND SYSTEM

[75] Inventor: Hoy R. Bohanon, Sr., Muskogee, Okla.

[73] Assignee: Acme Engineering & Manufacturing Corp., Muskogee, Okla.

[21] Appl. No.: 387,679

[22] Filed: Jun. 11, 1982

[51] Int. Cl.[3] ..... F24F 7/06

[52] U.S. Cl. ..... 98/31.5

[58] Field of Search ..... 98/33 A, 36, 38 R, 38 F, 98/40 D, 40 N

[56] References Cited

U.S. PATENT DOCUMENTS

| | | | |
|---|---|---|---|
| 2,310,222 | 2/1943 | Deverall | 98/33 A X |
| 2,510,524 | 6/1950 | Schramm | 98/33 A |
| 3,474,720 | 10/1964 | Qualley et al. | 98/33 R |
| 4,339,250 | 7/1982 | Thut | 98/36 X |

FOREIGN PATENT DOCUMENTS

| | | | |
|---|---|---|---|
| 1077767 | 5/1980 | Canada | 98/40 C |
| 1939384 | 8/1977 | Fed. Rep. of Germany | 98/36 |
| 129739 | 10/1979 | Japan | 98/33 A |
| 152335 | 11/1980 | Japan | 98/33 A |
| 8005841 | 5/1982 | Netherlands | 98/36 |
| 375861 | 7/1932 | United Kingdom | 98/33 A |

*Primary Examiner*—Harold Joyce

*Attorney, Agent, or Firm*—Staas & Halsey

[57] ABSTRACT

A method and apparatus for destratifying heat within an enclosure wherein a fan is positioned near the ceiling to draw warm air off the ceiling propelling same along a distribution tube also located near the ceiling and wherein the tube is provided with a plurality of openings along the bottom thereof through which the warm air is discharged toward the floor of the enclosure in the form of high velocity jets which entrain large quantities of surrounding ceiling air moving same to the vicinity of the floor of the enclosure.

7 Claims, 4 Drawing Figures

HEAT DESTRATIFICATION METHOD AND SYSTEM

BACKGROUND AND SUMMARY OF THE INVENTION

The present invention relates to a method and system for destratifying heat that accumulates near the ceiling in commercial and industrial buildings. It has long been known that in an enclosure air tends to stratify by temperature with hot air near the ceiling and cold air at the floor level. This is a stable situation physically since hot air is lighter and floats on the colder, heavier air. This phenomenon is particularly noticeable in the winter time when temperature variations from floor to ceiling of 20° F. are not unusual in large buildings.

In buildings where it is necessary to continuously exhaust inside air and replenish with outside air, it is possible to destratify the hot air by introducing the cold, outside [replacement] air near the ceiling where the hot air is stratified. In this connection, applicant's earlier issued U.S. Pat. Nos. 3,307,469, 3,318,224 and 3,524,399 disclose ventilating and circulating air systems featuring a distribution fan spaced from an adjustable shutter within a wall of the building, an air distribution tube mounted to the discharge end of the distribution fan and provided with openings throughout for jetting air into the building, and one or more exhaust fans mounted within the wall of the building, such that during the ventilating mode of operation the distribution and exhaust fans are running while the shutter is open causing cool outside air to be propelled down the tube thereafter being discharged through the openings into the interior of the building, the resulting small jets of air being well mixed with the air inside the building by turbulent mixing. In this manner, the heat at the top of the enclosure that normally would be wasted may actually be used to preheat the jets of cooler, incoming air.

In other buildings where little or no "make-up" air is required, other methods are needed to utilize the waste heat stratified at the top of the building. This can be accomplished by thoroughly mixing or homogenizing the air mass within the building so that the temperature will be essentially uniform from floor to ceiling, thus increasing the floor temperature where the people are located to increase comfort while reducing the ceiling temperature as well as reducing heat losses through the roof. The aforementioned mixing of the air mass must be accomplished with as low residual space velocity as is feasible since high velocity increases the feeling of coldness.

Room air warmed through a heat exchanger can be moved with a fan through a conduit to the vicinity of where people are working, and hot air stratified at the top of an enclosure can be collected and moved by a conduit to the vicinity of where people are working and released, either by a single outlet or a plurality of outlets. Such a system, primarily designed for warm air distribution, will not effectively destratify the great mass of unused, waste heat above the level where the people are located.

One system for controlling the flow of ventilating-tempering air into a building to cause the flow of air to remain primarily along the walls, ceilings and floor, to thereby achieve better distribution of incoming air and more uniform room temperature, is disclosed in U.S. Pat. No. 4,055,112 where the ventilating-tempering air is initially introduced into the room along a boundary surface such as a wall or ceiling and nozzles positioned below the ceiling which form air screens or jets below the ventilating-tempering air stream to guide it along the ceiling and down the walls, in conjunction with an intermediate grate-like ceiling of cross lamellae used to air in separating the ventilating-tempering air stream from the center of the room. In general it may be said that this type of system is not readily adaptable to large rooms.

In U.S. Pat. No. 2,046,215 there is disclosed a system for introducing conditioned air into an enclosure at high static pressure for expanding the air to approximately the pressure existing within the enclosure in the form of thin, elongated high velocity streams in a direction substantially parallel to the floor of the enclosure, thus inducing air within the enclosure to move and mix with the air being introduced to attemperate same. Such a system is generally not applicable for destratification.

With the present invention, heat destratification is accomplished with the use of a powered, inflated tube recirculating air system located near the ceiling of the enclosure. Hot air is drawn off the ceiling by the distribution fan and discharged down the tube as "primary" air and thereafter projected through relatively large openings in the bottom of the tube toward the floor. The high velocity jets leaving the tube entrain large quantities of surrounding ceiling air and move this "secondary" air toward the floor. An entrainment factor of ten to one or better is possible achieving a thorough mixing action of the entire room contents effectively destratifying the wasted ceiling heat.

DESCRIPTION OF THE PREFERRED EMBODIMENT

With the present invention, warm air is drawn off the ceiling by a suspended distribution fan and then discharged down a tube as "primary" air and then projected through large openings in the bottom of the tube toward the floor. The high velocity jets of air leaving the tube entrain large quantities of surrounding ceiling air and move this secondary air toward the floor achieving a thorough mixing action of the entire air content of the room effectively destratifying the available ceiling heat. A ratio of 10 to 1 in air mass momentum is achieved for a 1 to 10 change in average velocity, neglecting the buoyancy effect of the temperature gradient of the space. Due to the gradient effect somewhat less than a 1 to 10 velocity ratio is needed.

Figure 1:
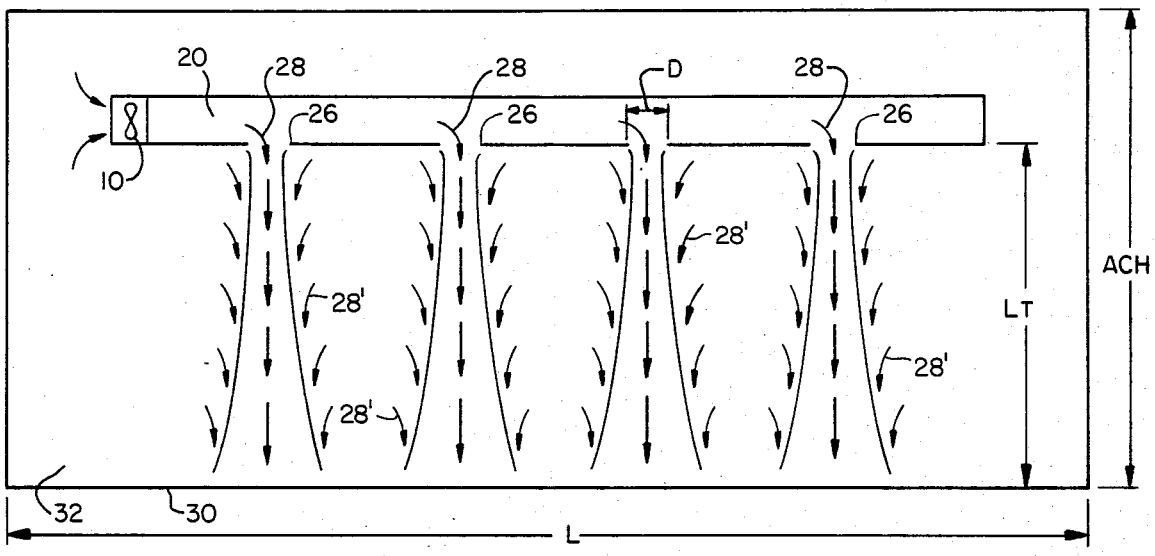
FIG. 1 is a front view schematically illustrating warm air being drawn off the ceiling by the distribution fan and thereafter being discharged down the tube as primary air, after which the primary air is projected through large openings in the bottom of the tube toward the floor as high velocity jets which entrain large quantities of surrounding secondary ceiling air moving same toward the floor.
Figure 2:
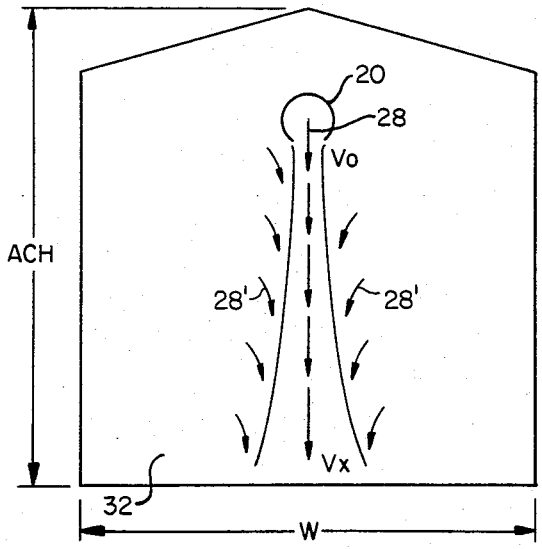
FIG. 2 is a side elevational view illustrating schematically the operation depicted in FIG. 1.
Figure 3:
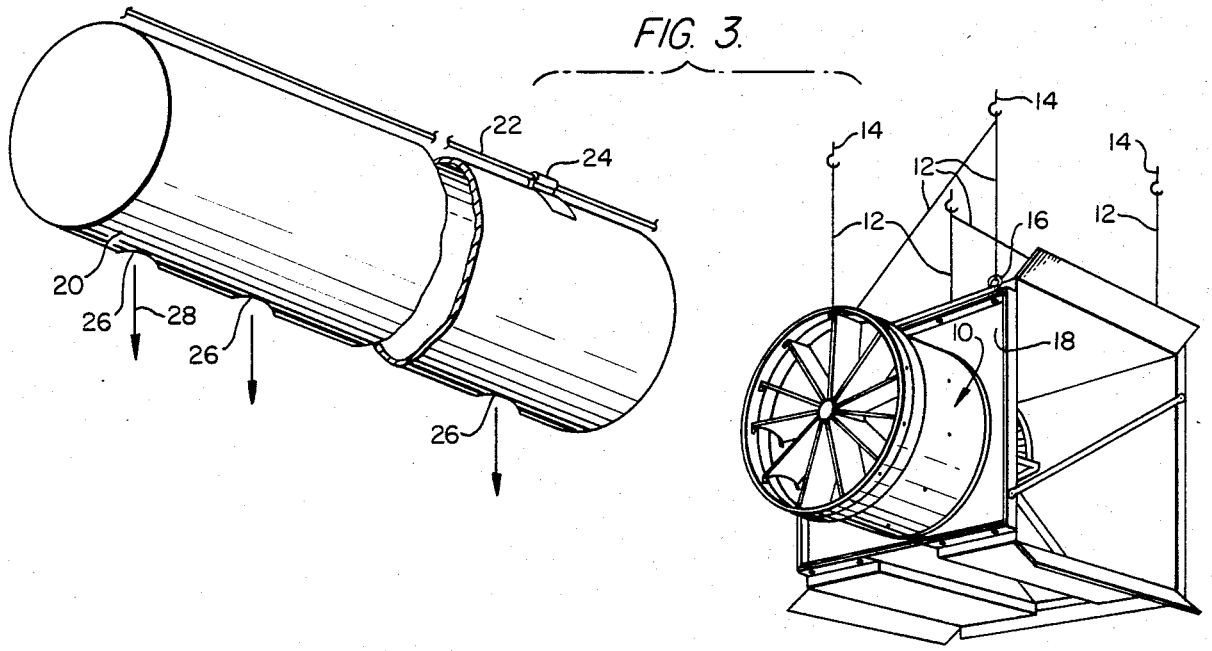
FIG. 3 is a perspective view of the air moving system for destratifying ceiling heat, including the distribution fan suspended near the ceiling of the enclosure, the tube connected to the discharge of the distribution fan which is provided with a plurality of large openings in the bottom thereof through which the high velocity jets of primary air are directed.

With reference to FIGS. 1–3, the distribution fan 10 is suspended from the ceiling with cables 12 which are attached at one end to fasteners 14 provided in the ceiling and at the other end to fasteners 16 secured to the frame 18 of the distribution fan 10. The discharge end of the distribution fan 10 is connected to the tube 20 which may by way of exemplification but not limitation be flexible polyethylene so as to be inflated by the air propelled by the distribution fan 10. The tube 20 is suspended at the ceiling of the enclosure by suitable means, which in the case where a flexible tube is used may include a wire 22 suspended in the ceiling which passes through fasteners 24 attached to the tube 20. For further information regarding the construction of the distribution fan 10 and tube 20 reference is made to applicant's U.S. Pat. Nos. 3,307,469, 3,318,224 and 3,524,399. At the bottom of the tube 20 are located a plurality of openings 26 through which the high velocity jets of primary air pass. With the foregoing description of the basic components of the heat destratification system, reference will now be made to the operating parameters of the system.

The size of the openings 25 is of great importance. If the openings 26 are too small, the jets of air will not reach the floor against an adverse density gradient. If the openings 26 are too large, insufficient mixing will occur and there will be excessive velocities at the floor line resulting in discomfort to personnel in the area. Properly sized, the jets 28 of primary air leaving the openings 26 will utilize most of their kinetic energy for mixing, with a small residual velocity at the floor. At this point, a mixing ratio of approximately ten to one or better can be achieved. Mathematical models indicate that the required sizes of the openings 26 depend upon the vertical distance from the bottom of the tube 20 to the floor 30 of the enclosure 32.

The need for experimentation was apparent during the development of the present invention. Initial experimentation demonstrated the tendency to overdesign the system. In one such experiment, where the system was designed for a flow rate of 1/20 of the building volume per minute and a stratification gradient of 1° F. per ft. the actual stratification gradient was $\frac{1}{3}$° F./ft. and after only a few minutes of operation was essentially zero. Thus, the buoyancy effect which had been of considerable concern did not exist, and the system worked in an isothermal mode. Subsequent tests, in part, were concerned with determining whether the jets would have penetrated to the floor with a smaller design gradient.

Based upon experimentation with the heat destratification system of the present invention, the procedure for selection of components and sizing will now be described.

Initially, the cubic volume of the building or enclosure is determined by multiplying the length "L" by the width "W" by the average ceiling height "ACH." In general, it may be stated that a rate of air change in most buildings of between two and four minutes is desirable. Thus, the total cubic feet per minute "CFM" of air moved is determined by dividing the cubic volume of the enclosure by the desired rate of air change, noted above.

The ratio of "primary" air to "secondary" air for the present system is approximately one to ten. For example, in the case of a distribution fan which has a "primary" air capacity of 10,000 CFM, the "secondary" air movement capability of approximately ten times that number is 100,000 CFM.

The number of systems, including the distribution fan 10 and tube 20, required for a particular building or enclosure is determined by dividing the total CFM by the "secondary" air movement capacity, as noted above.

It is then necessary to design the layout of the tube(s) 20 within the building. The tube lengths can vary from 75 to 180 ft. and should be spaced equally on the short axis of the building.

The initial temperature gradient (degrees per foot) in the enclosure is calculated by dividing the difference between the averages of the roof and floor temperatures by the roof height in feet. The distance from the bottom of the tube 20 to the floor will be determined on a job-by-job basis. In this connection it is to be noted that although it is desirable to position the tube 20 as high as possible within the enclosure 32, obstructions and the like must be taken into consideration.

Figure 4:
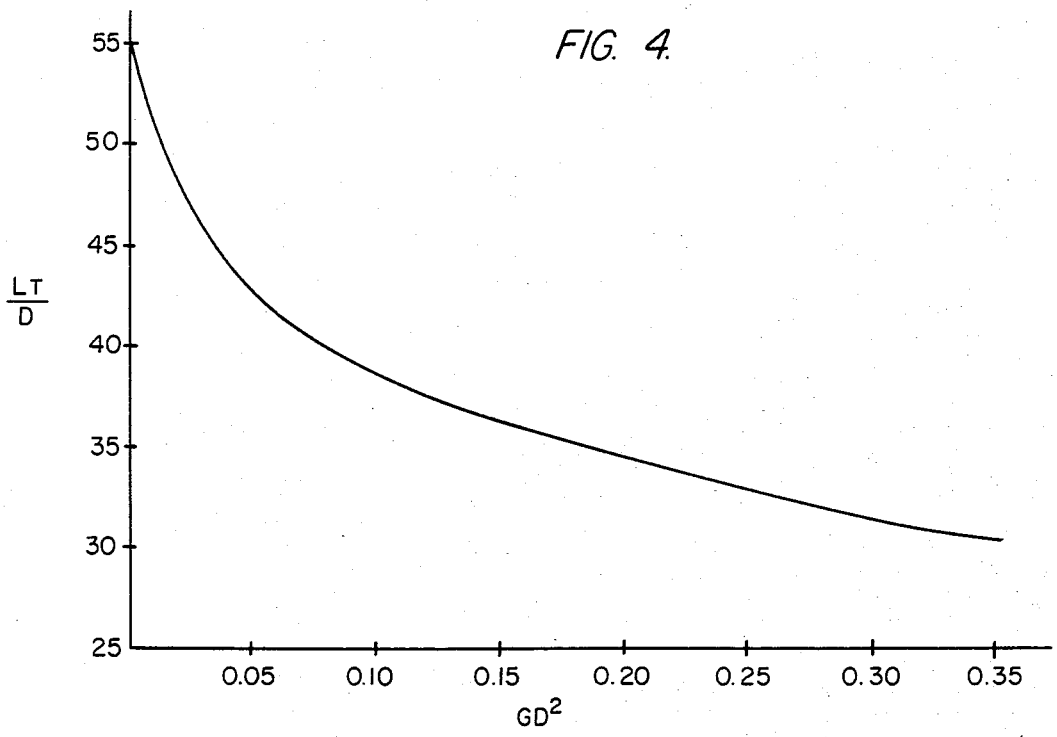
FIG. 4 is a graph plotting certain of the variables, including the vertical distance from the bottom of the tube to the floor of the enclosure, the diameter of the openings in the bottom of the tube, and the temperature gradient from the roof to the floor in the enclosure.

The size of the holes 26 within the tube 20 are determined from data accumulated during extensive experimentation with the heat destratification system of the present invention. The generalized graph of FIG. 4 plots certain of the variables, including the vertical distance from the bottom of the tube 20 to the floor of the enclosure in ft. ($L_T$), the temperature gradient from the roof to the floor of the enclosure in °F./ft. (G), and the diameter of the openings 26 in the distribution tube 20 in ft. (D), based upon an initial air velocity ($V_o$) of 2,200 feet per minute at the openings 26 and a terminal air velocity ($V_x$) of 100 feet per minute at the floor of the enclosure 32. The number of the holes within the tube 20 is determined from the capacity of the distribution fan 10, the diameter of the holes 26 and the available length of the tube 20.

It will be apparent that modifications may be made to the above disclosure without departing from the spirit and scope of the present invention as defined in the following claims.

I claim:

1. A method of destratifying heat within an enclosure, comprising:

drawing warm inside air off of the ceiling of the enclosure, propelling the warm inside air from the ceiling along a confined path that is separate from the remaining portions of the air within the enclosure, jetting the warm air downwardly from the confined path along a plurality of streams to the vicinity of the floor of the enclosure, and entraining quantities of surrounding warm air by the downward movement of each of the jetting streams thereby moving the surrounding warm air to the vicinity of the floor of the enclosure.

2. A method of destratifying heat within an enclosure as in claim 1, wherein the ratio of air propelled along the confined path to the air entrained by the jetting streams is in the approximate range one to ten.

3. A method of destratifying heat within an enclosure as in claim 1, wherein said confined path is located generally horizontally in the vicinity of the ceiling of the enclosure such that the warm air collected off the ceiling of the enclosure is jetted downwardly throughout the large mass of warm air located throughout the uppermost regions of the enclosure, and wherein the plurality of streams lie in vertically positioned planes intersecting the axis of said path at right angles and spaced uniformly along the axis of said path.

4. A heat destratification system for an enclosure, comprising a fan positioned near the ceiling of the enclosure to draw warm inside air off the ceiling of the enclosure, a distribution tube also located near the ceiling of the enclosure and connected to the discharge of the fan through which the warm air is propelled, and a plurality of openings along the bottom of the distribution tube through which the warm air is discharged to the vicinity of the floor of the enclosure in the form of high velocity jets of primary air which entrain large quantities of surrounding warm ceiling air moving same as secondary air to the vicinity of the floor of the enclosure.

5. A heat destratification system as in claim 4, wherein said openings are uniformly spaced along said distribution tube and are of a size such that the jets of primary warm air being discharged therethrough utilize most of their kinetic energy for mixing with a small residual velocity at the vicinity of the floor of the enclosure.

6. A heat destratification system as in claim 5, wherein said tube is of non-rigid material, air pressure from said fan holding said tube in its contemplated shape during use.

7. A heat destratification system as in claim 5, including means defining a ratio of approximately one to ten between the amount of primary air propelled downwardly through said openings in said tube to the vicinity of the floor and the amount of secondary surrounding warm air entrained by the primary air and moved to the vicinity of the floor.

* * * * *